US011085154B2

(12) United States Patent
Reindorf et al.

(10) Patent No.: US 11,085,154 B2
(45) Date of Patent: Aug. 10, 2021

(54) ADJUSTABLE WEAR SOLE

(71) Applicant: Wirtgen GmbH, Windhagen (DE)

(72) Inventors: Markus Reindorf, Cologne (DE); Willi Preis, Bad Honnef (DE)

(73) Assignee: Wirtgen GmbH

( * ) Notice: Subject to any disclaimer, the term of this patent is extended or adjusted under 35 U.S.C. 154(b) by 54 days.

(21) Appl. No.: 16/729,554

(22) Filed: Dec. 30, 2019

(65) Prior Publication Data

US 2021/0198852 A1 Jul. 1, 2021

(51) Int. Cl.
*E01C 19/00* (2006.01)
*E01C 19/48* (2006.01)
*E01C 19/42* (2006.01)

(52) U.S. Cl.
CPC ..... *E01C 19/48* (2013.01); *E01C 19/42* (2013.01); *E01C 2301/18* (2013.01)

(58) Field of Classification Search
CPC ..... E01C 19/42; E01C 19/48; E01C 2301/18
USPC ..... 404/83–118
See application file for complete search history.

(56) References Cited

U.S. PATENT DOCUMENTS 3,413,901 A * 12/1968 Lusk ..... E01C 23/026 404/87
3,673,930 A 7/1972 Birtchet
3,792,133 A * 2/1974 Goughnour ..... E01C 19/4893 264/33
3,970,405 A 7/1976 Swisher, Jr. et al.
6,273,636 B1 8/2001 Johanpeter
6,872,028 B2 3/2005 Aeschlimann et al.
6,984,089 B1 * 1/2006 Colvard ..... E01C 19/405 404/119
7,850,395 B1 * 12/2010 Brenner ..... G01B 21/30 404/75
7,950,874 B2 5/2011 Guntert, Jr. et al.
9,212,457 B2 * 12/2015 Wagner ..... E01C 19/42
9,290,893 B2 * 3/2016 Mittleman ..... E01C 19/48
10,844,556 B2 * 11/2020 Wehrenberg ..... E01C 19/4873

OTHER PUBLICATIONS

Guntert & Zimmerman Parts Manual, S850 QUADRA Slipform Paver (2008) (208 pages).
Guntert & Zimmerman brochure, S600 Multi-Purpose Slipform Paver (undated but admitted to be prior art)(16 pages).
Gomaco brochure, GP-4000 Slipform Paver (2016)(28 pages) (uploaded to USPTO in 2 parts).
Gomaco brochure, 5400 Series Paving Mold (2010)(2 pages).
Exhibit A—photo of Guntert & Zimmermann S1500 (2017)(1 page).
Exhibit B—photos of Guntert & Zimmermann S850 (2018)(2 pages).
Exhibit C—photo of Gomaco GP-4000 (2014)(1 page).
(Continued)

*Primary Examiner* — Raymond W Addie
(74) *Attorney, Agent, or Firm* — Lucian Wayne Beavers; Patterson Intellectual Property Law, PC

(57) ABSTRACT

A mold apparatus for a slipform paver includes front and rear frame members and a wear plate disposed below the front and rear frame members. At least one of the frame members includes a mounting flange. At least one adjustable fastener assembly is provided between the wear plate and the mounting flange. An adjusting nut drive may be either manually powered or automatically powered and provides access to the adjustable fastener assemblies from the interior of the mold apparatus.

26 Claims, 13 Drawing Sheets

(56) References Cited

OTHER PUBLICATIONS

Exhibit D—drawings of Wirtgen SP90 Series mold (undated but admitted to be prior art)(2pages).
European Search Report for corresponding patent application No. EP 20 21 7864 dated Jun. 9, 2021, 3 pages.

* cited by examiner

ADJUSTABLE WEAR SOLE

BACKGROUND OF THE INVENTION

1. Field of the Invention

The present disclosure relates generally to slip form paver machines, and particularly to an adjustable height wear plate for a mold of a slip form paver machine.

2. Description of the Prior Art

A slipform paving machine is designed to move in a paving direction across a ground surface and form concrete into a finished concrete structure. A typical slipform paver machine may be seen in U.S. Pat. No. 6,872,028 (WO 2002/101150) to Aeschlimann et al.

It is also known to provide adjustable height wear plates on the molds of a slipform paver. One examples of such a mold may be seen in Guntert U.S. Pat. No. 7,950,874.

There is a continuing need for improvements in the construction of molds having adjustable height wear plates

SUMMARY OF THE INVENTION

In one embodiment a mold apparatus for a slipform paver includes a front frame member and a rear frame member. At least one of the frame members includes a mounting flange having a fastener opening and a drive access opening defined at least in part by the mounting flange. A wear plate may be disposed below the front and rear frame members. At least one adjustable fastener assembly may be located inside the mold apparatus between the front frame member and the rear frame member and above the wear plate. The fastener assembly may include a threaded fastener attached to the wear plate and extending upward through the fastener opening of the mounting flange. A top nut may be attached to the threaded fastener above the mounting flange. An adjusting nut may be attached to the threaded fastener below the mounting flange such that the adjusting nut is accessible from inside the mold apparatus through the drive access opening.

The mold apparatus may include a manually powered adjusting nut drive configured to extend downward through the drive access opening to engage the adjusting nut so that a position of the wear plate below the mounting flange is adjustable. The adjusting nut drive may include a pivot guide configured to be received over the threaded fastener to pivot about a longitudinal axis of the threaded fastener. A handle may extend from the pivot guide and a drive lug may extend downward from the handle to engage the adjusting nut.

The mold apparatus alternatively may include an automatically powered adjusting nut drive configured to extend downward through the drive access opening to engage the adjusting nut so that a position of the wear plate below the mounting flange is adjustable. The automatically powered adjusting nut drive may include a drive motor and the driveshaft extending downward from the drive motor through the drive access opening. A drive bushing may be attached to the driveshaft. A drive gear may be attached to the driveshaft below the drive bushing and configured to engage the adjusting nut.

The drive bushing may be configured to be closely received within an at least partially circular portion of the drive access opening.

In another embodiment a mold apparatus for a slipform paver includes a front frame member and a rear frame member. At least one of the frame members may include a mounting flange having a fastener opening. A wear plate may be disposed below the front and rear frame members. At least one adjustable fastener assembly includes a threaded fastener attached to the wear plate and extending upward through the fastener opening of the mounting flange. A top nut may be attached to the threaded fastener above the mounting flange. An adjusting nut may be attached to the threaded fastener below the mounting flange. A manually powered adjusting nut drive may be configured to extend downward through the drive access opening to engage the adjusting nut so that a position of the wear plate below the mounting flange is adjustable. The adjusting nut drive may include a pivot guide configured to be received over the threaded fastener to pivot about a longitudinal axis of the threaded fastener. The adjusting nut drive may include a handle extending from the pivot guide, and a drive lug extending downward from the handle to engage the adjusting nut.

In another embodiment a mold apparatus for a slipform paver includes a front frame member and a rear frame member. At least one of the frame members may include a mounting flange having a fastener opening and a drive access opening. A wear plate may be disposed below the front and rear frame members. At least one adjustable fastener assembly may include a threaded fastener attached to the wear plate and extending upward through the fastener opening of the mounting flange. A top nut may be attached to the threaded fastener above the mounting flange. An adjusting nut may be attached to the threaded fastener below the mounting flange. The drive access opening may include an at least partially circular portion having a center offset from a longitudinal axis of the threaded fastener. An automatically powered adjusting nut drive may be configured to extend downward through the drive access opening to engage the adjusting nut so that a position of the wear plate below the mounting flange is adjustable. The adjusting nut drive may include a drive motor and a driveshaft extending downward from the drive motor through the at least partially circular portion of the drive access opening. A drive bushing may be attached to the driveshaft and configured to be closely received within the at least partially circular portion of the drive access opening. A drive gear may be attached to the driveshaft below the drive bushing and configured to engage the adjusting nut.

In any of the above embodiments the adjusting nut may include a plurality of external recesses.

In any of the above embodiments the external recesses may be configured as notches in an external periphery of the adjusting nut, each notch being defined between two opposed substantially parallel notch sides.

In any of the above embodiments the adjusting nut may be configured as a gear and the external recesses may be configured as spaces between gear teeth.

In any of the above embodiments the driveshaft opening may include an arc-shaped portion configured to receive a lug of a drive tool and to allow the lug to move in an arc about a longitudinal axis of the threaded fastener to rotate the adjusting nut relative to the threaded fastener.

In any of the above embodiments the arc shaped portion of the drive access opening may extend through an arc in a range of from about 60° to about 120°.

In any of the above embodiments the drive lug may include two substantially parallel opposed driving sides.

In any of the above embodiments a cylindrical spacer bushing may be received about the threaded fastener between the mounting flange and the top nut. The pivot guide of the adjusting nut drive may include a cylindrical bore through the pivot guide, the cylindrical bore being received about the cylindrical spacer bushing when the lug of the adjusting nut drive is engaged with one of the notches of the adjusting nut.

In any of the above embodiments the adjusting nut drive may include a ratchet between the drive lug and the handle.

In any of the above embodiments the drive access opening may include an at least partially circular portion having a center offset from a longitudinal axis of the threaded fastener.

In any of the above embodiments the adjustable fastener assembly may include a washer plate between the mounting flange and the adjusting nut. The washer plate may include an eccentric portion extending under the drive access opening and having a guide opening defined therein for closely receiving a guide bushing of an automatically powered adjusting nut drive.

One advantage of the embodiments disclosed herein is that the location of the adjustable fastener assemblies in the interior of the mold shelters the adjustable fastener assemblies from the harsh environment external of the mold. This is combined with mold drive constructions which provide ready access to the adjustable fastener assemblies from the interior of the mold.

Another advantage is provided by the use of adjustable fastener assemblies adjacent both the front and rear frame members of the mold, thus providing complete adjustability of the position of the wear plate relative to the frame of the mold.

Numerous other objects, features and advantages of the embodiments set forth herein will be readily apparent to those skilled in the art upon reading of the following disclosure when taken in conjunction with the accompanying drawings.

DETAILED DESCRIPTION

Figure 1:
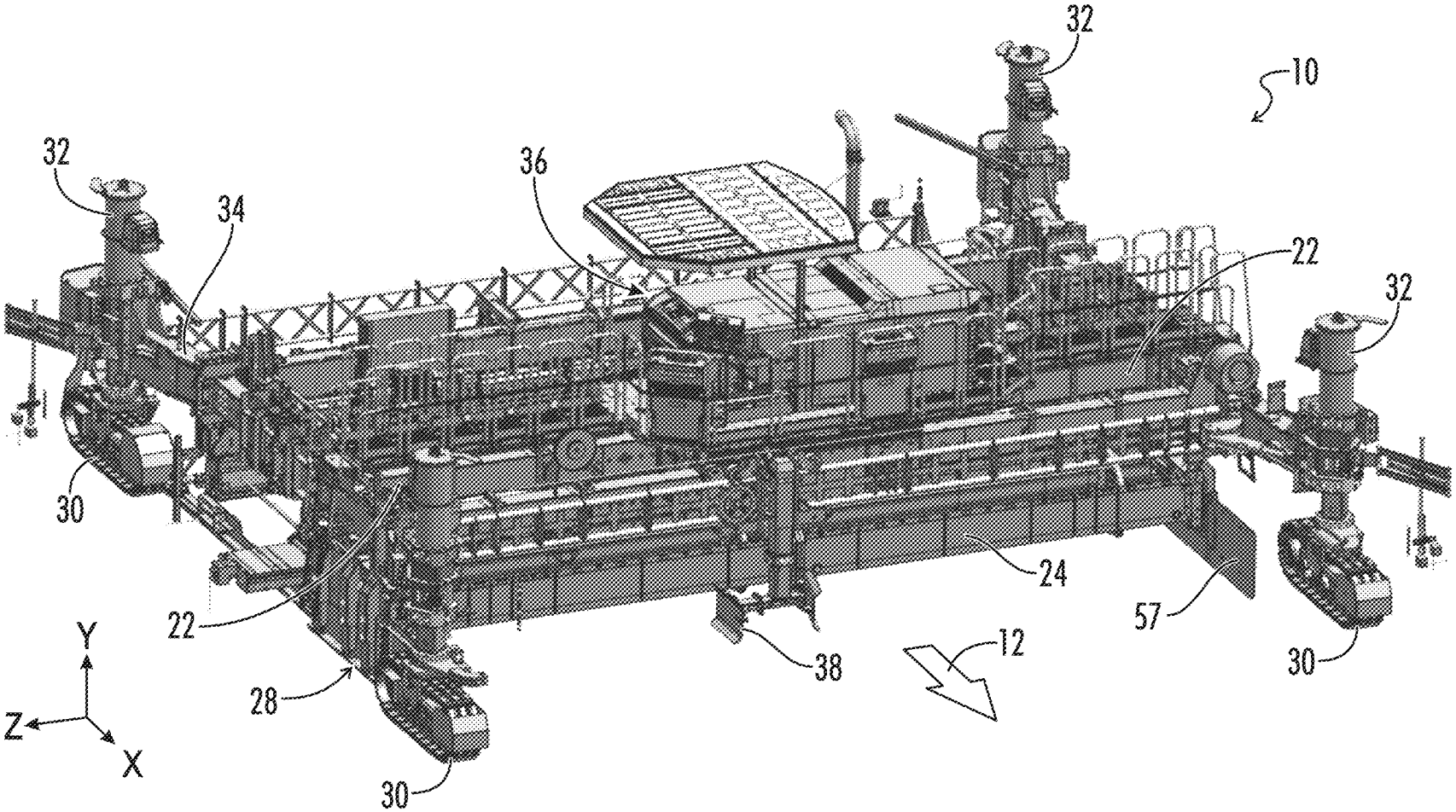
FIG. 1 is a front perspective view of a slipform paver including the mold apparatus with adjustable wear sole of the present invention.
Figure 2:
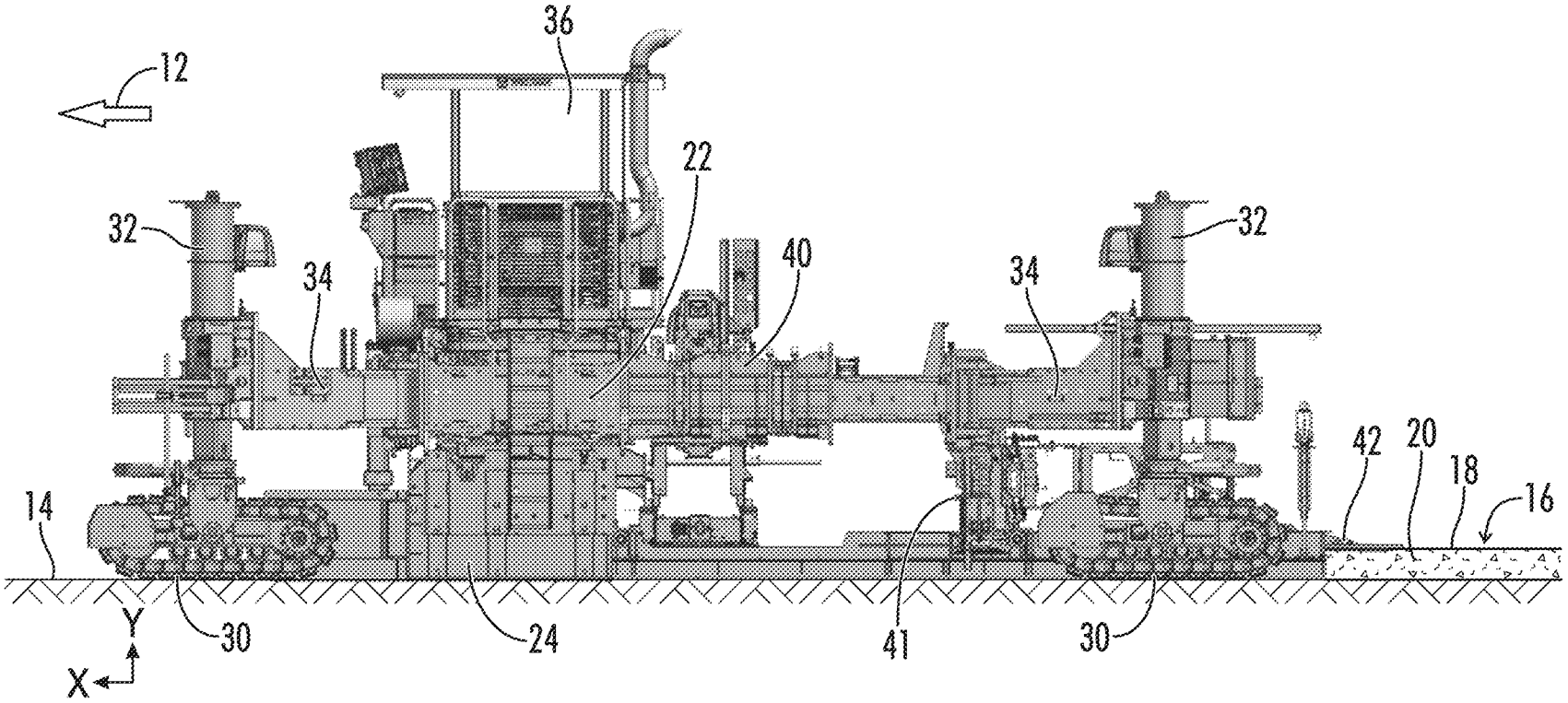
FIG. 2 is a left side elevation view of the slipform paver of FIG. 1.

Referring now to the drawings, and particularly to FIGS. 1 and 2, a slipform paver apparatus is shown and generally designated by the number 10. The details of construction of a typical slipform paver apparatus may be seen in U.S. Pat. No. 6,872,028 (WO 2002/101150) to Aeschlimann et al., which is incorporated herein by reference.

As is schematically illustrated in FIGS. 1 and 2 the apparatus 10 is configured to move in a paving direction 12 across a ground surface 14 for spreading, leveling and finishing concrete into a finished concrete structure 16 having a generally upwardly exposed concrete surface 18 and terminating in lateral concrete sides such as 20.

The slipform paver apparatus 10 includes a main frame 22 and a slipform paver mold 24 supported from the main frame 22. The slipform paver mold 24 may be either an adjustable width mold apparatus 24 or a fixed width mold apparatus.

The main frame 22 is supported from the ground surface by a plurality of ground engaging units such as 30, which in the illustrated embodiment are tracked ground engaging units 30. Wheeled ground engaging units could also be used. Each of the ground engaging units 30 is connected to the main frame 22 by a lifting column such as 32 which may be attached to a swing arm such as 34. An operator's platform 36 is located on the main frame 22. A plow or spreader device 38 may be supported from the main frame 22 ahead of the slipform paver mold 24. Behind the slipform paver mold 24 a dowel bar inserter apparatus 40 may be provided. Behind the dowel bar inserter apparatus 40 an oscillating beam 41 and a super smoother apparatus 42 may be provided.

The main frame 22 includes a plurality of laterally telescoping frame members that allow the width of the main frame to be adjusted. The adjustment of the main frame width may be accomplished using hydraulic ram actuators embedded in the main frame, or the traction power of the ground engaging units 30 may be used to extend and retract the main frame 22. When the width of the main frame 22 is adjusted it may also be necessary to adjust the width of the mold apparatus 24.

A bottom surface of the mold apparatus 24 is typically formed from a smooth steel plate, generally referred to as a wear plate or a wear sole, and this bottom surface serves to form or mold the smooth upper surface 18 of the molded concrete structure 16. Due to the great width of the paving machine 10 and the mold apparatus 24, this wear plate is often formed of adjacent sections across the width of the paving machine. This is especially true if the mold apparatus is an adjustable width mold apparatus which is constructed to receive removable mold sections. Or if the mold apparatus is of the fixed width type it may be constructed of segments bolted together, and again there may be adjacent segments of the wear plate. In order to avoid discontinuities in the surface 18 of the molded concrete structure 16 it is desirable to be able to adjust the height of the adjacent sections of the wear plate.

Figure 3:
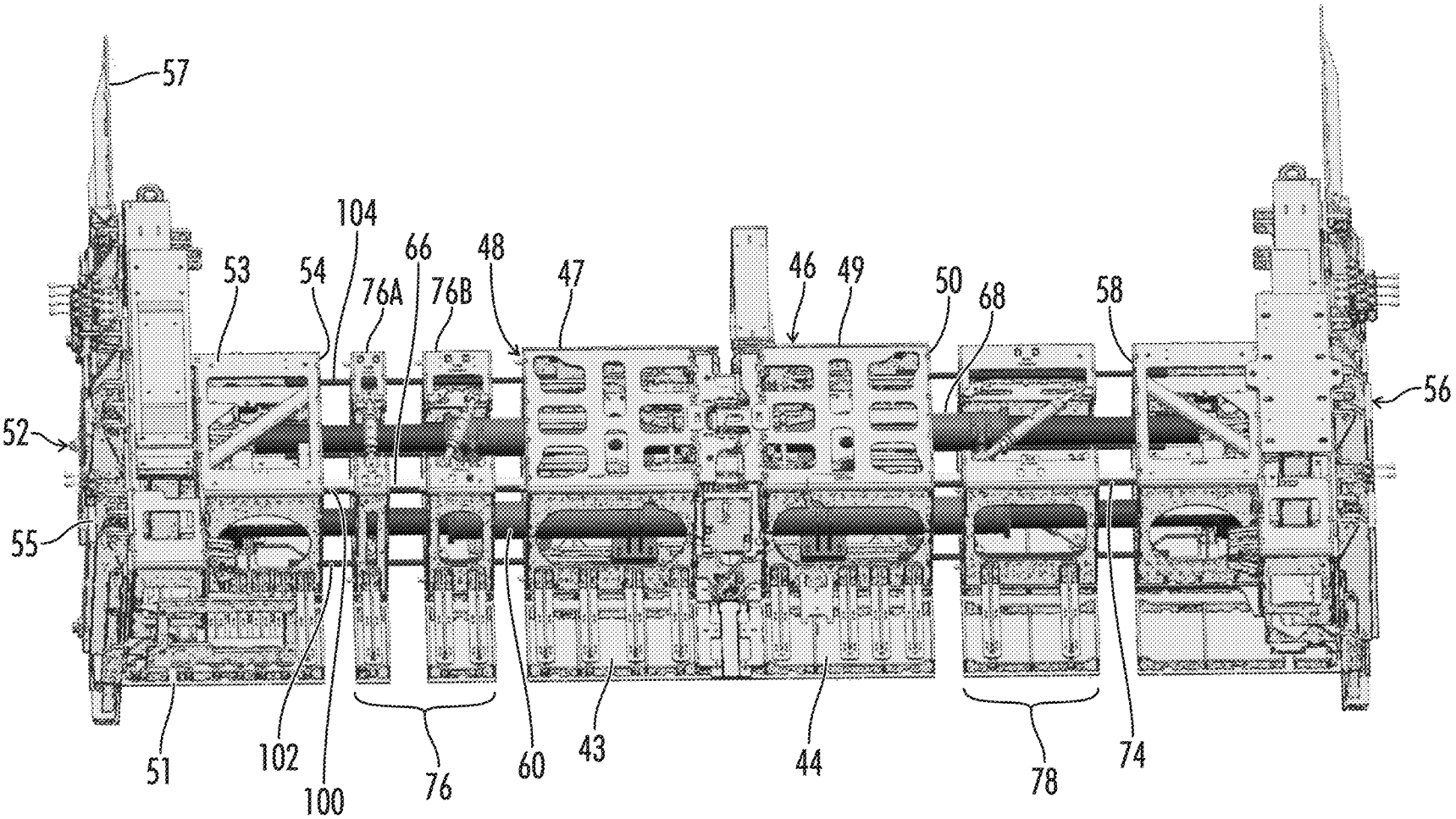
FIG. 3 is an elevated perspective view of an adjustable width mold apparatus showing the placement of removable spacers within the mold.

FIG. 3 shows in elevated perspective view an adjustable width mold apparatus 24. The adjustable width mold apparatus 24 includes a center portion 46 terminating in left and right lateral ends 48 and 50. The center portion 46 may be of the type configured to allow the formation of a crown in the molded concrete structure 16. In such an embodiment, the center portion 46 includes a left center portion half 47 and a right center portion half 49 joined together by a pivoted connection such that the left and right center portion halves 47 and 49 can be pivoted relative to each other to form a crown in the molded structure 16. Left and right center portion pan portions 43 and 44 are attached to the bottom of the left and right center portion halves 47 and 49 and define the center portion of the generally horizontal mold surface for forming the top surface 18 of the molded concrete structure 16.

The adjustable width mold apparatus 24 further includes a left sideform assembly 52 having a laterally inner end 54 and a right sideform assembly 56 having a laterally inner end 58.

The left sideform assembly 52 may include a sideform framework 53 on which the laterally inner end 54 is defined. A left sideform assembly pan portion 51, which may also be referred to as a wear plate 51, is attached to the bottom of the sideform framework 53 and defines the leftmost portion of the generally horizontal mold surface for forming the top surface 18 of the molded concrete structure 16. The left sideform assembly 52 may further include a left sideform 55 which extends vertically downward from the sideform framework 53 to seal the left end of the mold and thus to form the left wall 20 of the molded structure 16. A guide panel 57 may extend forward from the sideform 55 to guide the unformed concrete mixture into the mold. The right sideform assembly 56 is similarly constructed.

A left telescoping support assembly 60 is connected between the left sideform assembly 52 and the center portion 46. The left telescoping support assembly 60 includes a left actuator 66 for extending and retracting the left telescoping support assembly 60 so as to move the left sideform assembly 52 away from or toward the center portion 46.

A right telescoping support assembly 68 similarly includes a right actuator 74 for extending and retracting the right telescoping support assembly 68. The extension of the left and right telescoping support assemblies can also be aided by use of the ground engaging units 30.

One or more left spacers 76 (designated here as 76A and 76B) are configured to be received between the laterally inner end 54 of the left sideform assembly 52 and the left lateral end 48 of the center portion 46, such that upon retraction of the left telescoping support assembly 60 a laterally innermost one 76B of the one or more left spacers 76 is held directly against the left lateral end 48 of the center portion 46. Similarly, upon retraction of the left telescoping support assembly 60 a laterally outermost one 76A of the one or more left spacers 76 is held directly against the laterally inner end 54 of the left sideform assembly 52.

Similarly, one or more right spacers 78 are configured to be received between the laterally inner end 58 of the right sideform assembly 56 and the right lateral end 50 of the center portion 46.

Figure 4:
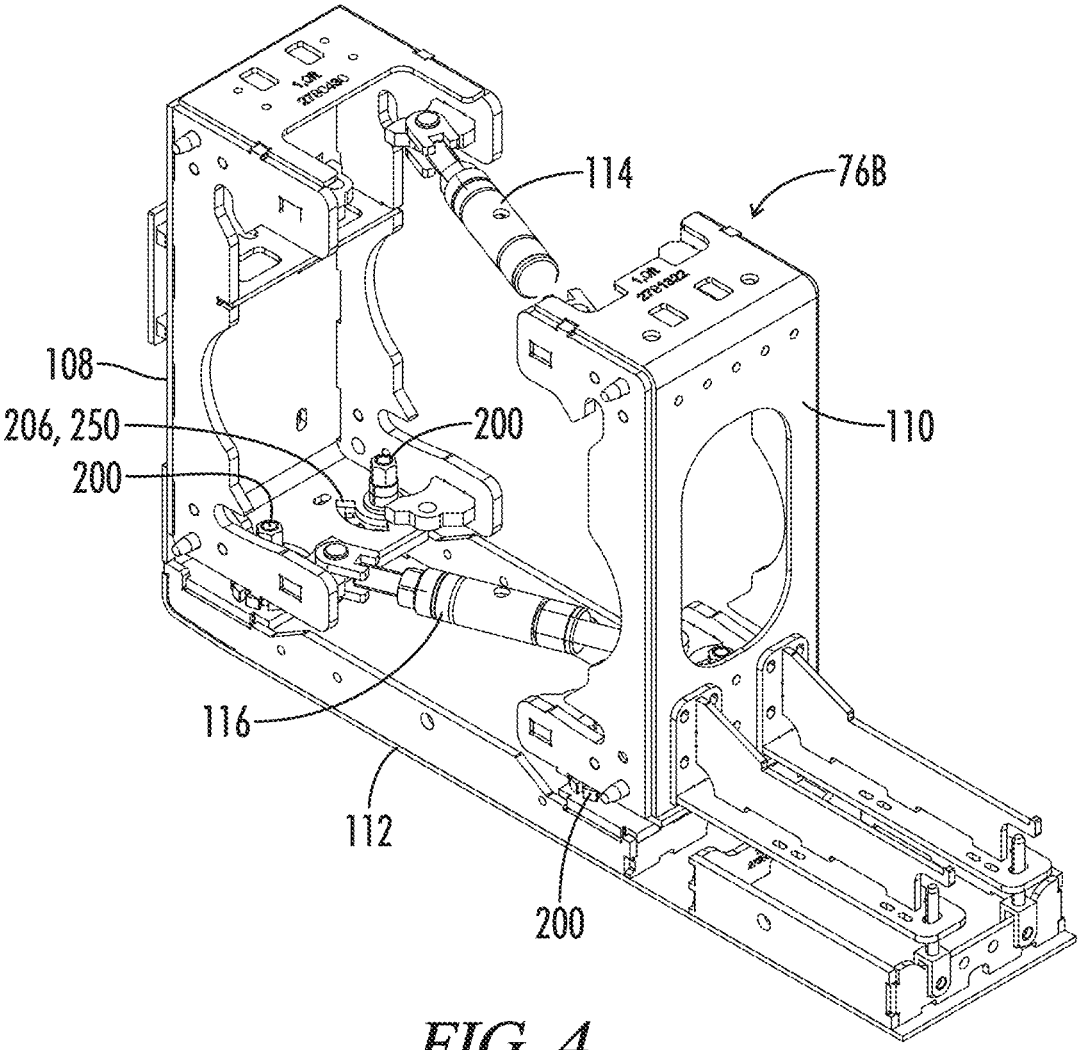
FIG. 4 is a perspective view of one of the removable spacers having an adjustable wear plate.

As is seen in FIG. 4 each of the left side spacers, such as the spacer 76B includes a forward spacer portion or front frame member 108, a rearward spacer portion or rear frame member 110, a pan or wear plate 112, an upper adjustable length connector 114 and a lower adjustable length connector 116. The upper and lower adjustable length connectors 114 and 116 may for example be turnbuckles. The spacers 76 are installed in the view of FIG. 3 upon a plurality of hanger rods such as 100, 102 and 104.

Figure 5:
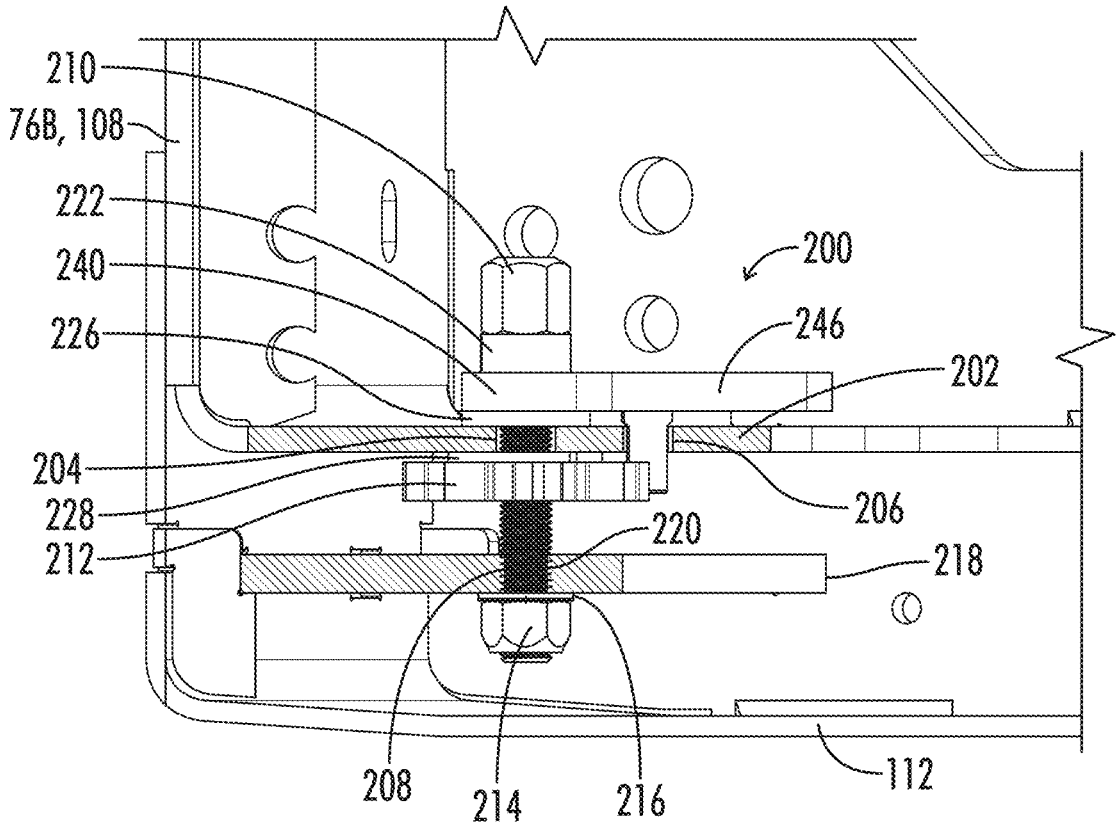
FIG. 5 is an enlarged left side elevation view of a lower front portion of the removable spacer of FIG. 4, including an adjustable fastener assembly for height adjustment of the wear plate using a manually powered adjusting nut drive.
Figure 6:
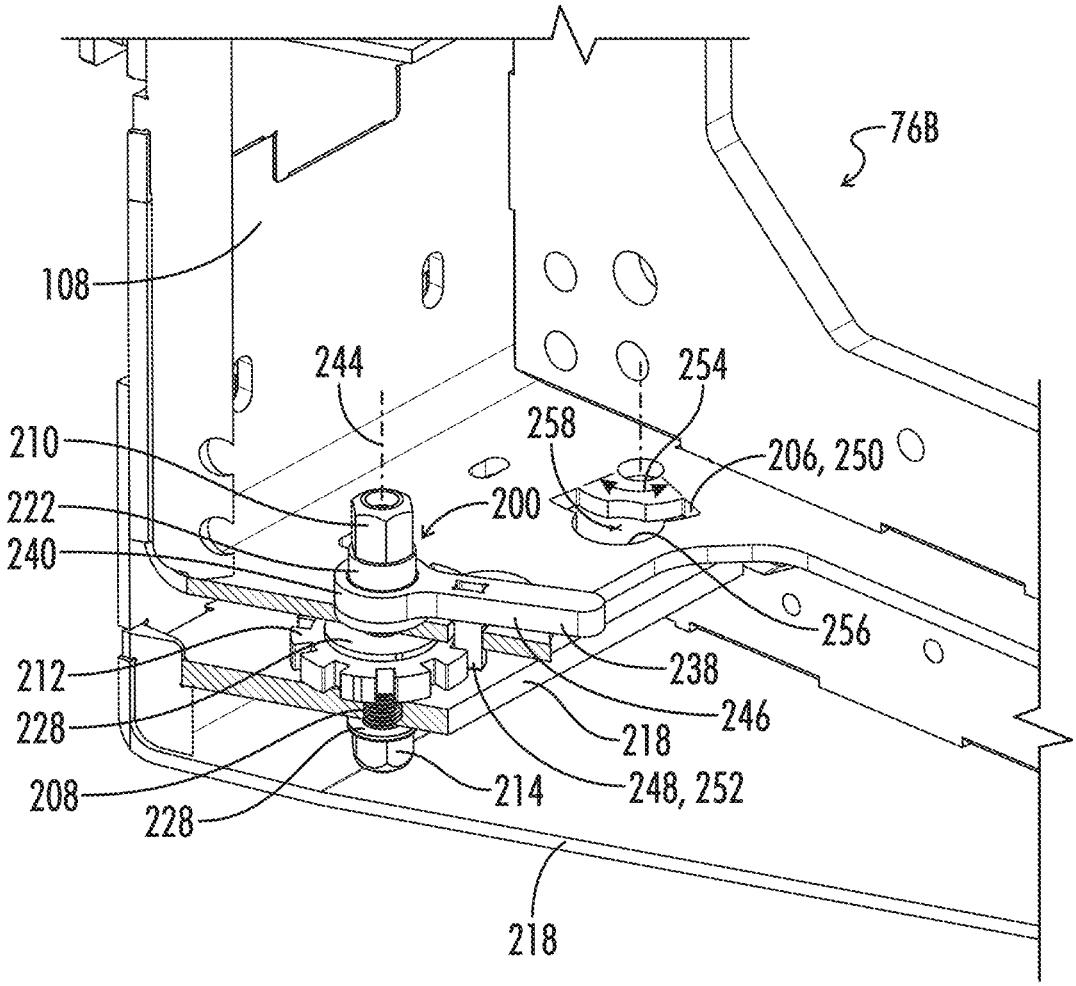
FIG. 6 is a perspective view of the apparatus of FIG. 5.
Figure 7:
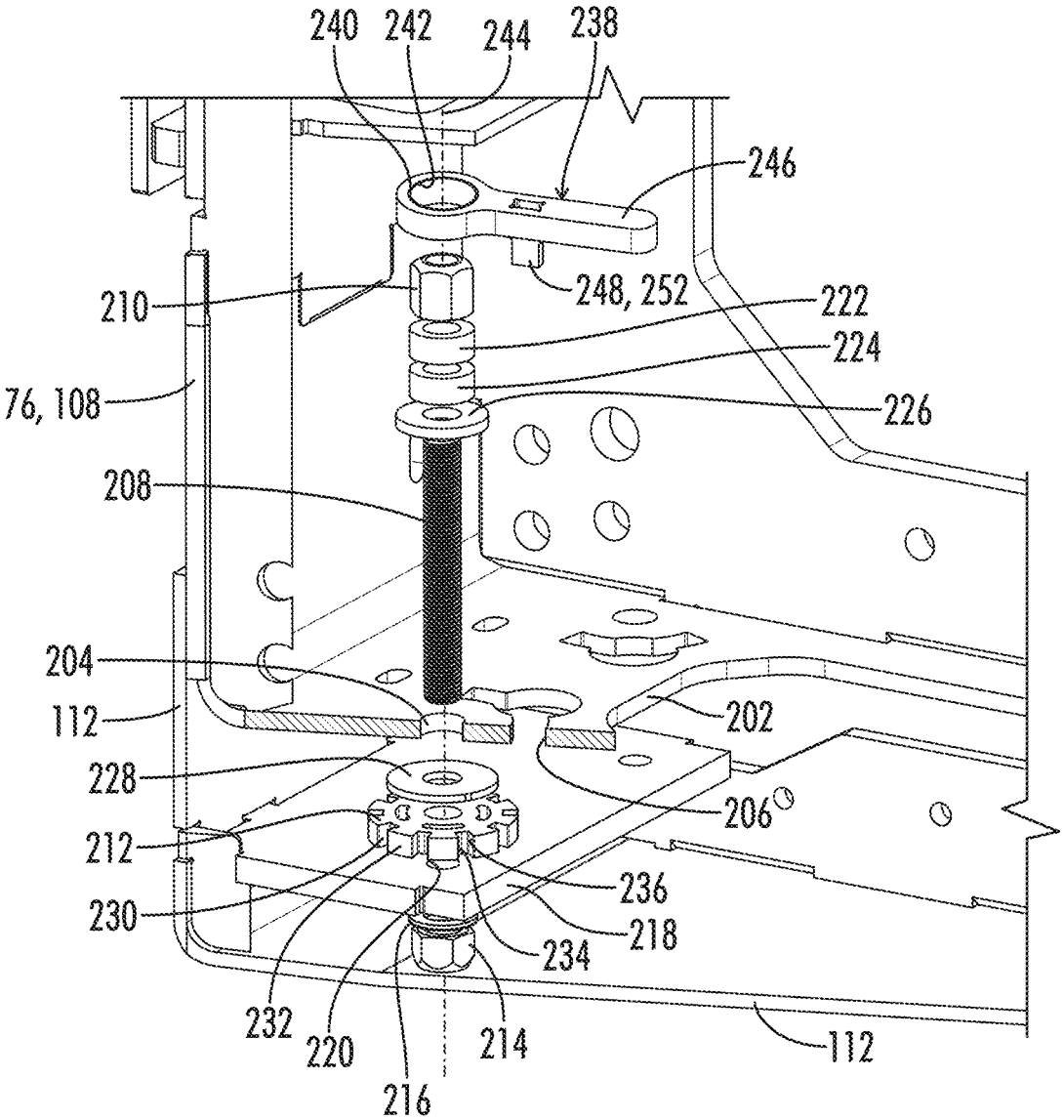
FIG. 7 is an exploded view of the apparatus of FIG. 5.
Figure 8:
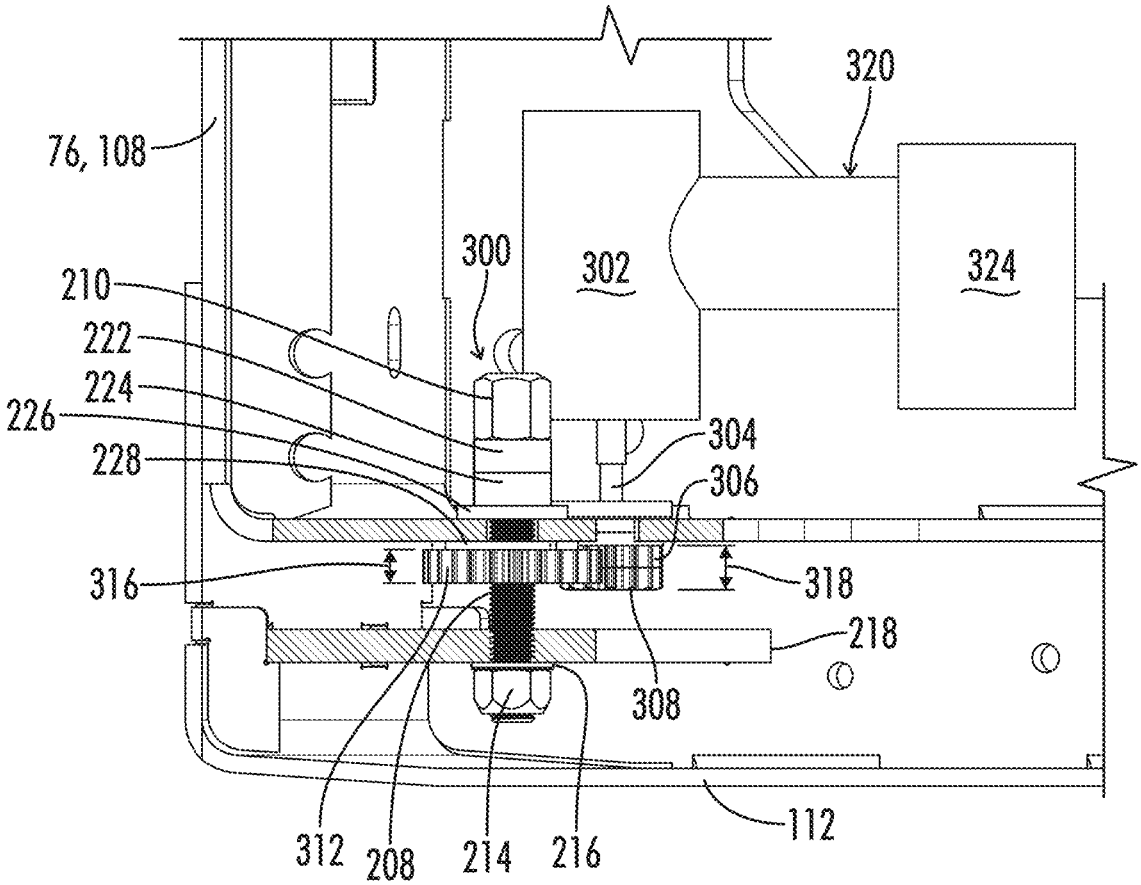
FIG. 8 is an enlarged left side elevation view of the lower front portion of the removable spacer of FIG. 4, including an adjustable fastener assembly for height adjustment of the wear plate using an automatically powered adjusting nut drive.
Figure 9:
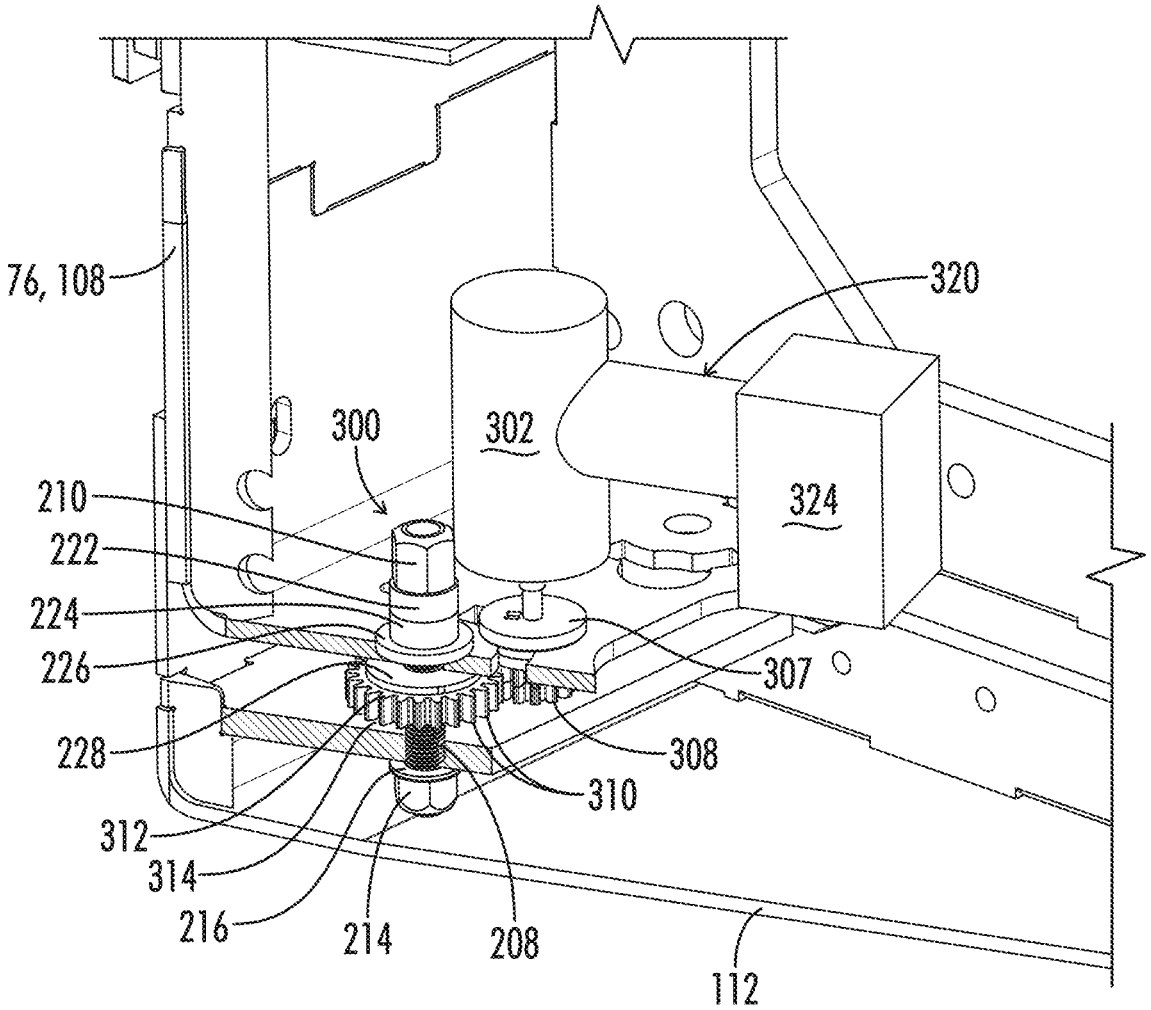
FIG. 9 is a perspective view of the apparatus of FIG. 8.
Figure 10:
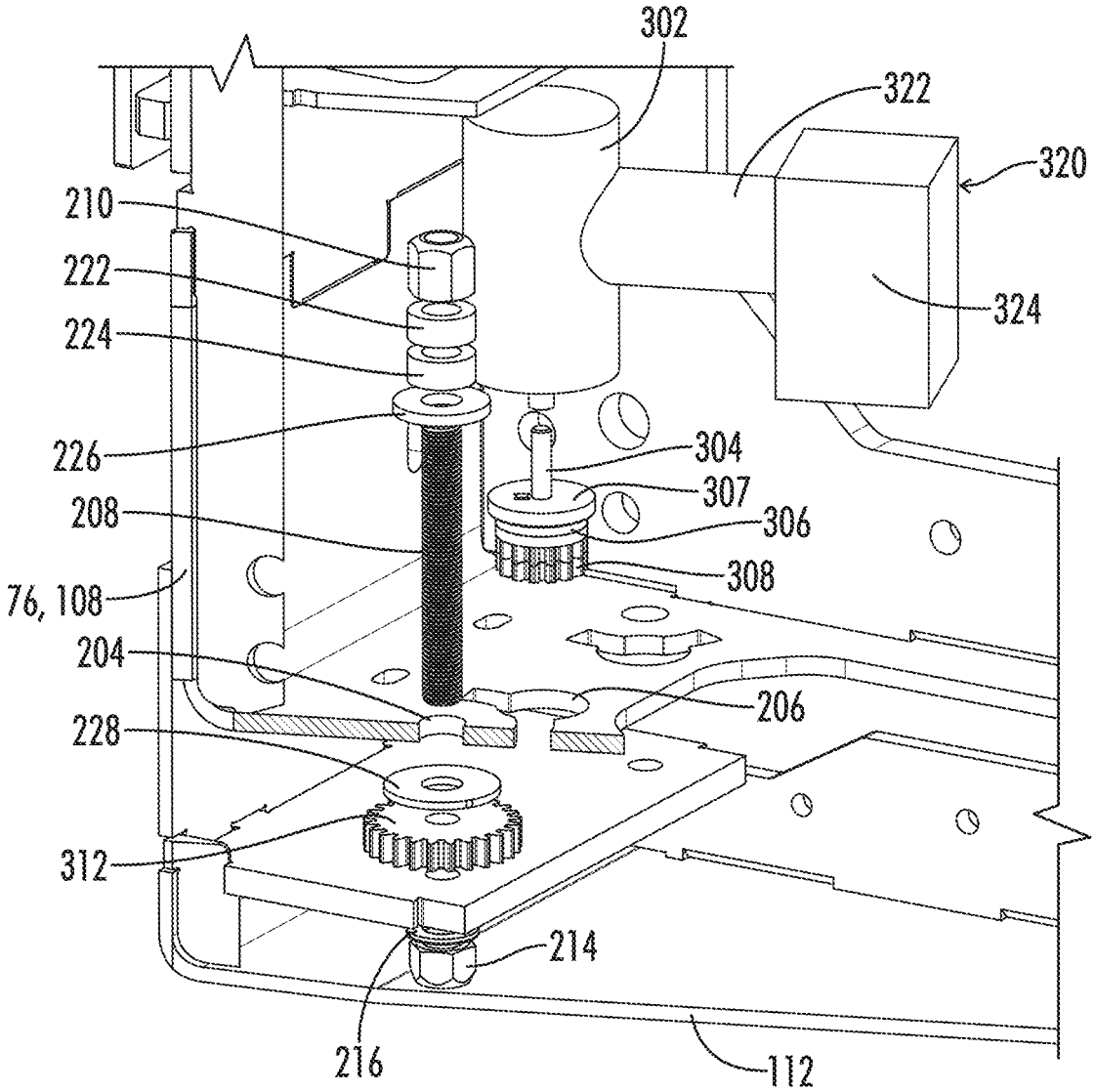
FIG. 10 is an exploded view of the apparatus of FIG. 8.

In order that the wear plates 112 of the adjacent spacers, and the wear plates such as 51 of the sideform assemblies 52 and 56, and the wear plates 43, 44 of the center portion 46 may all be adjusted to provide a smooth combined lower surface of the mold apparatus 24, each of the wear plates may be mounted upon its respective spacer 76, 78 or its portion of the sideform assemblies 52, 56 or center portion 46 with one or more adjustable fastener assemblies such as 200 seen in FIGS. 5-7 or such as 300 seen in FIGS. 8-10.

Depending upon the width of the spacer it may include one or more of the adjustable fastener assemblies 200, 300 connecting the wear plate 112 to the front frame member 108, and one or more of the adjustable fastener assemblies 200, 300 connecting the wear plate to the rear frame member 110. For example, the spacer 76B seen in FIGS. 3 and 4, has four of the adjustable wear assemblies 200. Two are connected between the wear plate 112 and the front frame member 108, and two are connected between the wear plate 112 and the rear frame member 110. Portions of three of the adjustable fastener assemblies 200 are visible and identified in the perspective view of FIG. 4.

FIG. 5 is a left side elevation partly sectioned view of the lower left front corner portion of the spacer 76B of FIG. 4. There the front frame member 108 is seen to include a mounting flange 202 having a fastener opening 204 and a drive access opening 206 defined therein. More generally the openings 204 and 206 may be described as being defined at least in part by the mounting flange 202.

As best seen in FIG. 4, the adjustable fastener assembly 200 may be located inside the spacer 76B of mold apparatus 24 between the front frame member 108 and the rear frame member 110 and above the wear plate 112.

The adjustable fastener assembly 200 may include a threaded fastener 208 attached to the wear plate 112 and extending upward through the fastener opening 204 of the mounting flange 202. A top nut 210 may be attached to the threaded fastener 208 above the mounting flange 202. An adjusting nut 212 may be attached to the threaded fastener 208 below the mounting flange 202, such that the adjusting nut 212 is accessible from inside the mold apparatus 24 through the drive access opening 206.

In the illustrated embodiment the wear plate 112 includes a lower mounting flange 218. The threaded fastener 208 is shown to be threadedly received in a lower threaded bore 220 of the lower mounting flange 218. The threaded fastener 208 is locked in place relative to the lower mounting flange 218 of the wear plate 112 with a bottom nut 214 threaded onto the threaded fastener 208. A washer 216 may be located between the bottom nut 214 and the bottom surface of the lower mounting flange 218. Alternatively, the threaded fastener 208 could be attached to the wear plate 212 by welding. Further alternatively, the threaded fastener could have an eye at its lower end and be attached to the wear plate 112 via a pin connection.

The components of the adjustable fastener assembly 200 are best illustrated in the exploded view of FIG. 7. The adjustable fastener assembly 200 further includes first and second spacer bushings 222 and 224 and a washer 226, located between the top nut 210 and the mounting flange 202. A lower washer 228 may be located between the mounting flange 202 and the adjusting nut 212.

In the embodiment of FIGS. 5-7, the adjusting nut 212 is disk shaped and includes a plurality of external recesses 230 configured as notches in an external periphery 232 of the adjusting nut 212. Each of the notches 230 is defined between two opposed substantially parallel notch sides such as 234 and 236.

The adjustable fastener assembly 200 of FIGS. 5-7 is designed for use with a manually powered adjusting nut drive 238 configured to extend downward through the drive access opening 206 to engage the adjusting nut 212 so that a position of the wear plate 112 below the mounting flange 202 of the front frame member 108 of spacer 76B is adjustable.

The manually powered adjusting nut drive 238 includes a pivot guide 240 having a cylindrical bore 242 therethrough configured to be received over the threaded fastener 208 and more particularly to be closely received about the spacer bushings 222 and 224, so that the manually powered adjusting nut drive 238 may pivot about a longitudinal axis 244 of the threaded fastener 208. A handle 246 extends from the pivot guide 240, and a drive lug 248 extends downward from the handle 246.

The drive access opening 206 may include an arc shaped portion 250 configured to receive the drive lug 248 and to allow the drive lug 248 to move in an arc 254 about the longitudinal axis 244 of the threaded fastener 208 to rotate the adjusting nut 212 relative to the threaded fastener 208. The arc shaped portion 250 may encompass an arc 254 in a range of from about 60 degrees to about 120 degrees The notches 230 of the adjusting nut 212 are configured to receive the drive lug 248. The drive lug 248 preferably includes two substantially parallel opposed driving sides such as 252 seen in FIG. 7. A second parallel driving side is on the opposite side of the drive lug 248.

With the manually powered adjusting nut drive 238, the bore 242 of pivot guide 240 is placed over the guide bushings 224 and 226 which are closely received in the bore 242. The drive 238 is lowered until its drive lug 248 is received in one of the notches 230 of the adjusting nut 212. Then the drive 238 is manually rotated about axis 244 to rotate the adjusting nut 212 upon the threaded fastener 208 through some portion of the arc 254 to adjust the height of the wear plate 112 relative to the front spacer frame 108. The drive 238 may then be lifted and re-engaged with another notch 230 to again rotate the adjusting nut through some portion of the available arc 254. When the desired height of wear plate 112 is achieved the adjustable fastener assembly 200 is locked in place by tightening the top nut 210.

Figure 13:
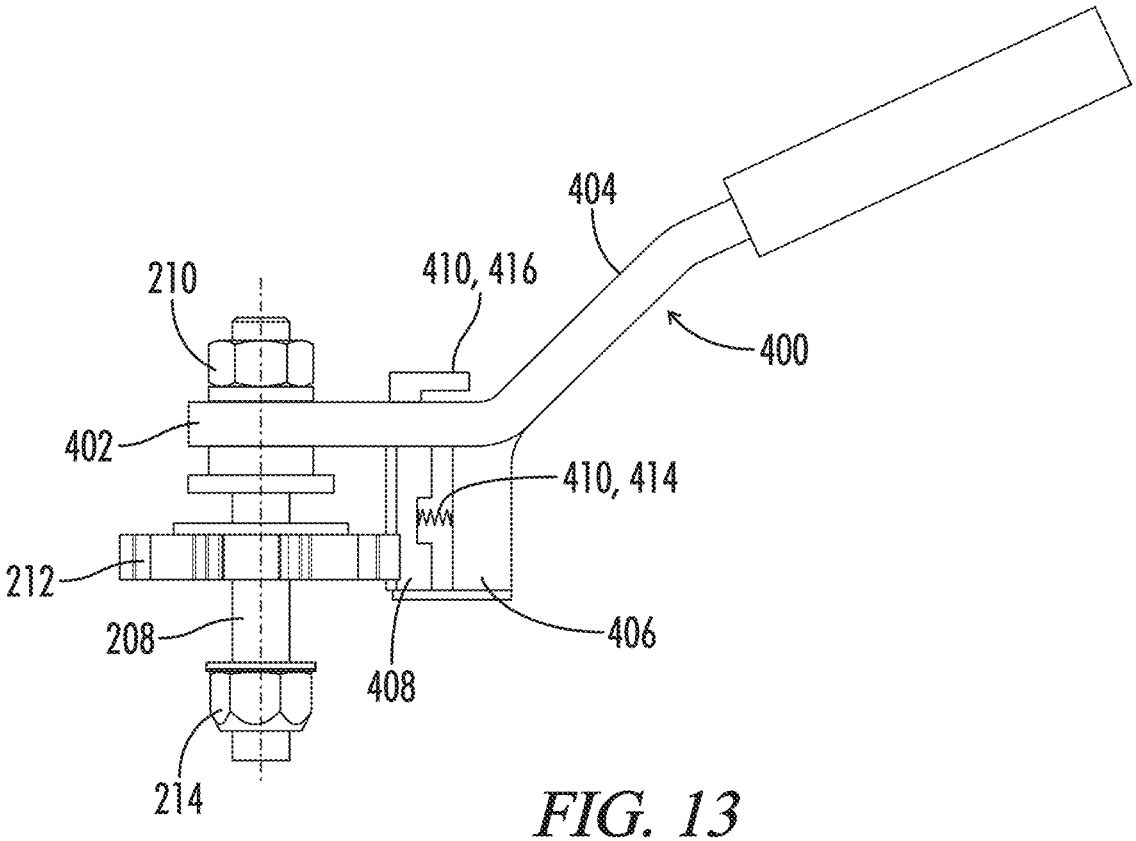
FIG. 13 is a schematic side elevation view of an alternative embodiment of a manually powered adjusting nut drive including a ratchet engaged with the adjustable fastener assembly.
Figure 14:
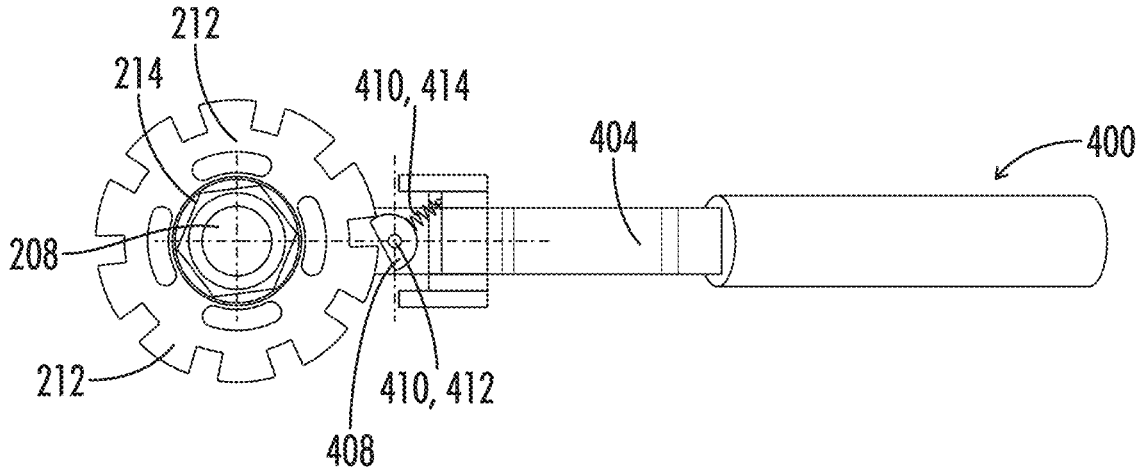
FIG. 14 is a schematic bottom view of the apparatus of FIG. 13.

Optionally the manually powered adjusting nut drive may be constructed with a ratchet between the drive lug and the handle as is shown in FIGS. 13 and 14. In FIG. 13 a side elevation view is shown of a modified manually powered adjusting nut drive designated by the number 400. The adjusting nut drive 400 includes a pivot guide 402 and a handle 404. The pivot guide 402 fits closely over the spacer bushings 222 and 224 in the same manner as the previously described embodiment. The handle 404 includes a downward extending protrusion 406 on which is mounted a drive lug 408 with a ratchet 410 between the drive lug 408 and the protrusion 406 of handle 404. The ratchet 410 includes a pivotal mounting 412 of the drive lug 408 on the handle 404, and a biasing spring 414 which can be adjusted in position to selectively bias the drive lug 408 in a selected rotational direction about the longitudinal axis 244 of the threaded fastener 208. And adjustment switch 416 on the handle 404 can switch the direction of the ratchet 410 so that the adjusting nut drive 400 can either tighten or loosen the adjusting nut 212. In FIG. 14 a schematic bottom view of the apparatus of FIG. 13 is shown, with the drive lug 408 engaged with the adjusting nut 212 in a position to loosen the adjusting nut 212.

It is noted that in the FIGS. 5-10 the drive access opening 206 includes both the arc shaped portion 250 and an at least partially circular portion 256 having a center 258 offset from the longitudinal axis 244 of the threaded fastener 208.

As shown in FIGS. 8-10 the at least partially circular portion 256 of the drive access opening 206 is configured to receive an automatically powered adjusting nut drive 301 configured to extend downward through the at least partially circular portion 256 of drive access opening 206 to engage the adjusting nut 312 of an adjustable fastener assembly 300 so that a position of the wear plate 112 below the mounting flange 202 is adjustable. It is noted that the construction of the adjustable fastener assembly 300 is substantially the same as the adjustable fastener assembly 200 except for the construction of the adjusting nut. In the adjustable fastener assembly 300 the adjusting nut 312 is in the form of a gear. The other components of the adjustable fastener assemblies are identical and carry identical part numbers in the drawings.

The automatically powered adjusting nut drive 301 includes a drive motor 302 and a drive shaft 304 extending downward from the drive motor 302 through the at least partially circular portion 256 of the drive access opening 206. A drive bushing 306 is received about the drive shaft 304 and configured to be closely received within the at least partially circular portion 256 of the drive access opening 206. A positioning flange 307 is located above the drive bushing 306 to limit the downward insertion of the drive shaft 304. A drive gear 308 is attached to the driveshaft 304 below the drive bushing 306 and configured to engage the adjusting nut 312 when the drive bushing 306 is received in the at least partially circular portion 256 of the drive access opening 206. The drive motor 302 may be part of a hand held tool assembly 320 having a handle 322 and battery pack 324. It is noted that the at least partially circular portion 256 of the drive access opening 206 does not have to be defined as a complete circle. The at least partially circular portion 256 may be defined as a complete circle, or as partial arc of a circle, or even as a series of engagement points lying upon a circle. It is only necessary that the at least partially circular portion 256 be configured so that it will closely receive the rotatable drive busing 306 and guide the same.

In the embodiment of FIGS. 8-10, the adjusting nut 312 is configured as a gear 312 have the external gear teeth 310. In this embodiment the external recesses of the adjusting nut 312 are configured as spaces 314 between the gear teeth 310.

As is best seen in FIG. 8, the gear teeth 310 of the adjusting nut 312 have an axial adjusting nut tooth height 316. The drive gear 308 has an axial drive gear tooth height 318 which is greater than the axial adjusting nut tooth height 316. This allows a range of location of the drive gear 308 in the axial direction while still maintaining engagement between the drive gear 308 and the gear teeth 310 of the adjusting nut 312.

When the drive gear 308 is engaged with the adjusting nut 312 the adjusting nut may be rotated to adjust the height of the wear plate 112.

It is noted that in FIGS. 5-10 the drive access opening 206 is illustrated as having both the arc shaped portion 250 and the at least partially circular portion 256. The arc shaped portion 250 allows use of the adjustable fastener assemblies 200 with the manually powered adjusting nut drive 238. The at least partially circular portion 256 allows use of the adjustable fastener assemblies 300 with the automatically powered adjusting nut drive 301. Alternatively, the drive access opening 206 can be configured to have only the arc shaped portion 250 such as is seen for example in the embodiment of FIG. 4. Also, the drive access opening could be configured to have only the at least partially circular portion 256.

Figure 11:
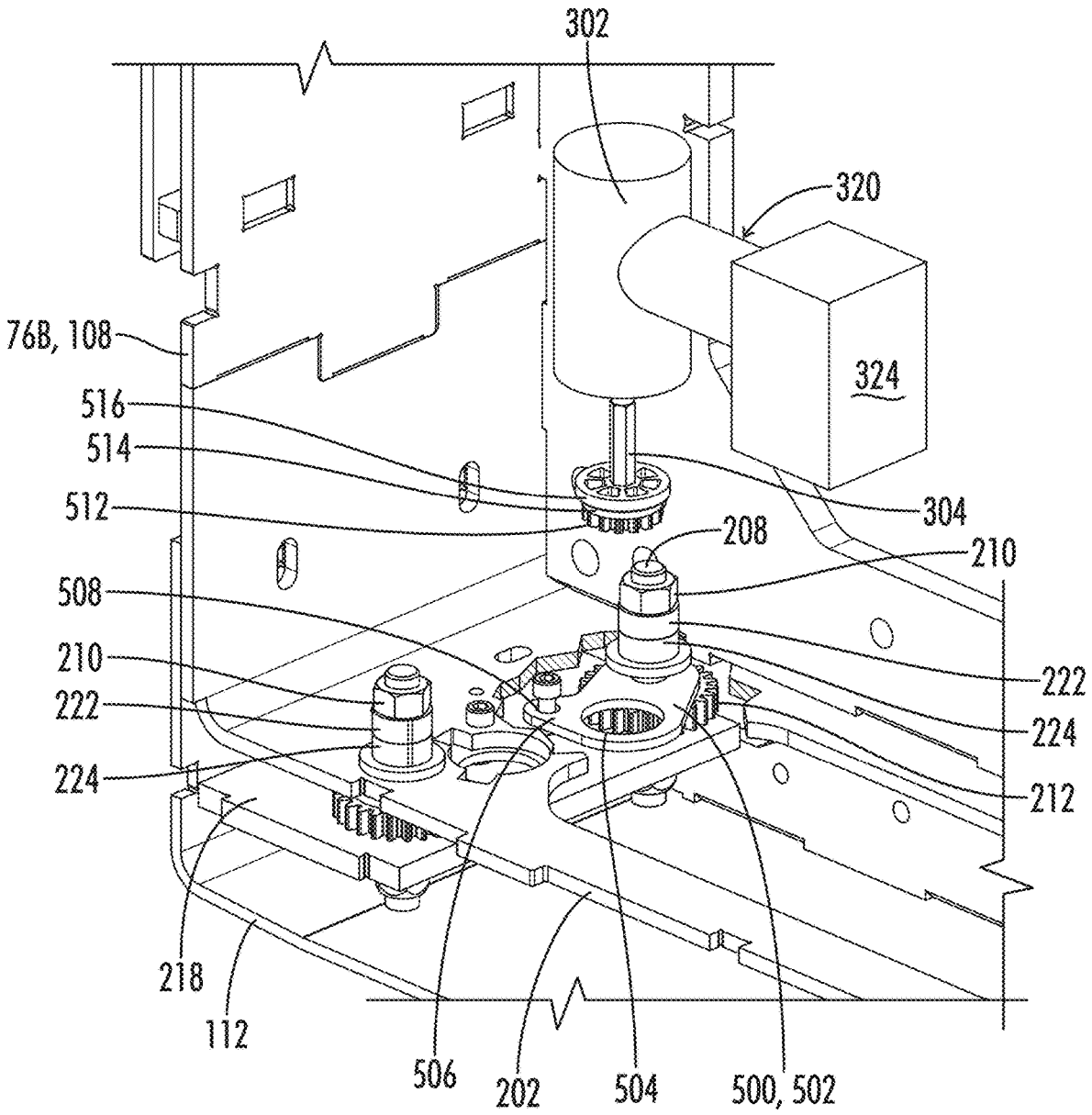
FIG. 11 is a perspective, partly sectioned, view of a removable spacer similar to that of FIG. 4 and showing an alternative embodiment of an adjustable fastener assembly and an automatically powered adjusting nut drive in exploded view.
Figure 12:
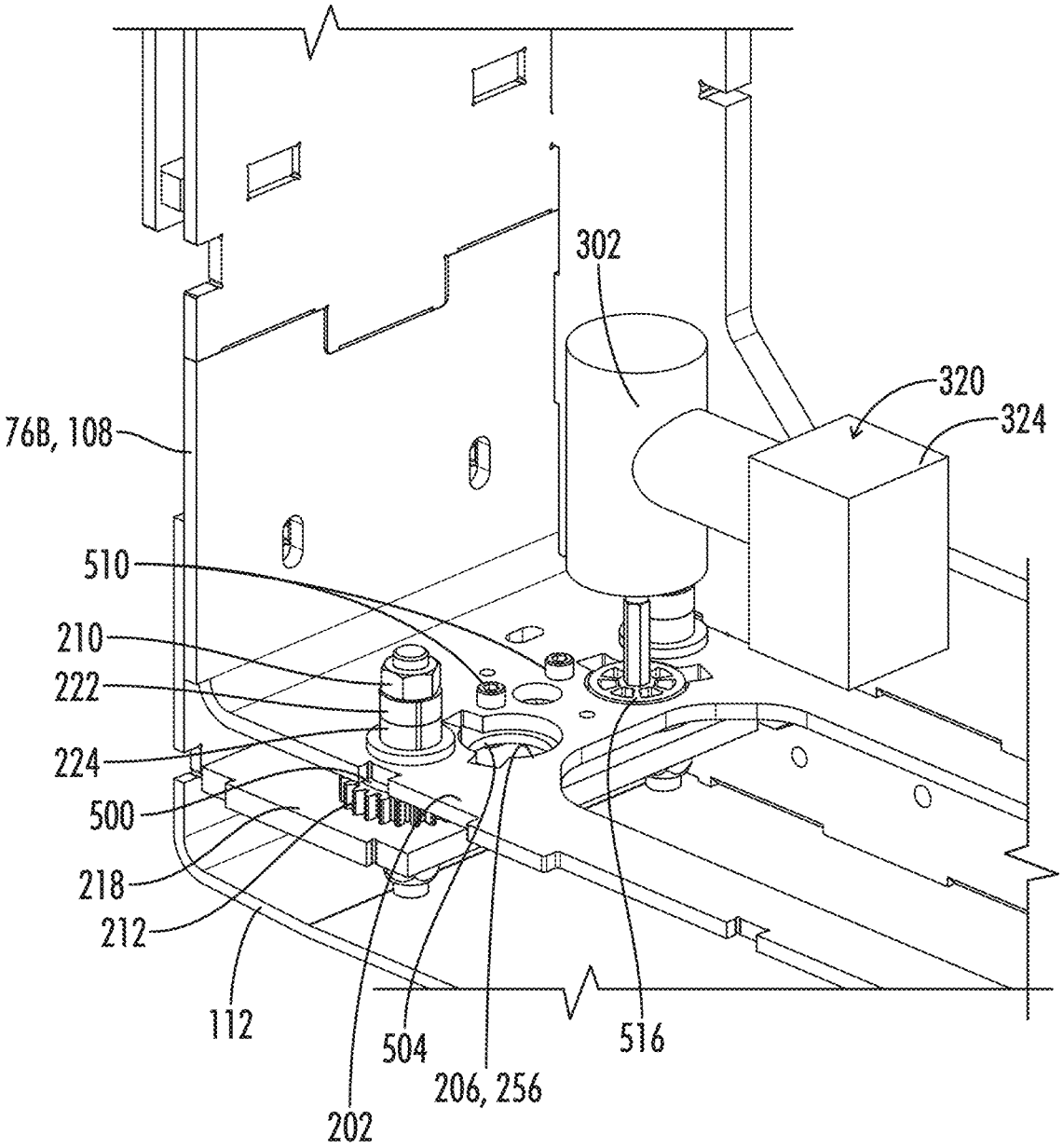
FIG. 12 is an enlarged view of a portion of FIG. 11 showing the apparatus of FIG. 11 assembled and with the automatically powered adjusting nut drive engaged with the adjusting nut.

A modified embodiment of the adjustable fastener assembly and the automatically powered adjusting nut drive is shown in FIGS. 11 and 12. In this embodiment, instead of having the drive bushing received in an at least partially circular portion of the drive access opening, a circular guide opening is provided in a washer plate of the adjustable fastener assembly. This provides a more precise alignment of the drive gear with the adjusting nut, as compared to the embodiment of FIGS. 8-10.

In FIG. 11 the adjustable fastener assembly includes a washer plate 500 received about the threaded fastener 208 between the mounting flange 202 and the adjusting nut 212. The washer plate 500 may replace the lower washer 228 of the embodiment of FIGS. 5-10. The washer plate 500 includes an eccentric portion 502 extending under the drive access opening 206. The eccentric portion 502 has a circular guide opening 504 defined therethrough. An ear 506 of the eccentric portion 502 includes a bolt hole 508 for an anchor bolt 510 (see FIG. 12) which anchors the washer plate 500 against rotation about the threaded fastener 208. As is best seen in FIG. 12, the circular guide opening 504 may be concentrically located below the at least partially circular portion 256 of the drive access opening 206.

The automatically powered adjusting nut drive 320 of FIGS. 11 and 12 includes a modified drive gear 512, drive bushing 514 and positioning flange 516. The drive shaft 304 and attached components are inserted downwardly through the drive access opening 206 and the circular guide opening 504 until the drive gear 512 engages the teeth of the adjusting nut 312 and the drive bushing 514 is closely received in the circular guide opening 504 with the positioning flange 516 abutting a top surface of the washer plate 500. The close engagement of the drive bushing 514 with the circular guide opening 504 holds the drive gear 512 in engagement with the teeth of the adjusting nut 212. It is noted that the guide opening 504 does not have to be completely circular, but only needs to be configured so that it will closely receive and guide the drive bushing 514.

In the embodiments of FIGS. 5-10 the mold apparatus has been illustrated as a removable segment of an adjustable width mold. As previously noted, however, the mold apparatus may be of the fixed width type of unitary construction or constructed of segments bolted together, and again there may be adjacent segments of the wear plate. Also, the wear plates 51 of the sideform assemblies 52, 56 and the wear plates 43, 44 of the center portion 46 may be mounted on their respective frameworks using the same adjustable fastener assemblies 200, 300 described above. For example, the left sideform assembly 52 may have its wear plate 51 attached to its sideform framework 53 using a plurality of the adjustable fastener assemblies 200, 300.

Thus it is seen that the apparatus and methods of the present invention readily achieve the ends and advantages mentioned as well as those inherent therein. While certain preferred embodiments of the invention have been illustrated and described for purposes of the present disclosure, numerous changes in the arrangement and construction of parts and steps may be made by those skilled in the art, which changes are encompassed within the scope and spirit of the present invention as defined by the appended claims.

What is claimed is:

1. A mold apparatus for a slipform paver, the mold apparatus comprising:
- a front frame member;
- a rear frame member;
- at least one of the frame members including a mounting flange having a fastener opening and a drive access opening defined at least in part by the mounting flange;
- a wear plate disposed below the front and rear frame members; and
- at least one adjustable fastener assembly located inside the mold apparatus between the front frame member and the rear frame member and above the wear plate, the fastener assembly including:
  - a threaded fastener attached to the wear plate and extending upward through the fastener opening of the mounting flange;
  - a top nut attached to the threaded fastener above the mounting flange; and
  - an adjusting nut attached to the threaded fastener below the mounting flange such that the adjusting nut is accessible from inside the mold apparatus through the drive access opening.

2. The apparatus of claim 1, wherein:
- the at least one adjustable fastener assembly includes at least one front adjustable fastener assembly connecting the wear plate to the front frame member and at least one rear adjustable fastener assembly connecting the wear plate to the rear frame member.

3. The apparatus of claim 1, wherein:
- the mold apparatus is a spacer mold apparatus for an adjustable width mold;
- the front frame member is a removable front spacer frame member; and
- the rear frame member is a removable rear spacer frame member.

4. The apparatus of claim 1, wherein:
- the mold apparatus is a fixed width mold apparatus; and
- the front and rear frame members are parts of a fixed width mold frame.

5. The apparatus of claim 1, wherein:
- the adjusting nut includes a plurality of external recesses.

6. The apparatus of claim 5, wherein:
- the external recesses are configured as notches in an external periphery of the adjusting nut, each notch being defined between two opposed substantially parallel notch sides.

7. The apparatus of claim 5, wherein:
- the adjusting nut is configured as a gear and the external recesses are configured as spaces between gear teeth.

8. The apparatus of claim 1, wherein:
- the drive access opening includes an arc shaped portion configured to receive a lug of a drive tool and to allow the lug to move in an arc about a longitudinal axis of the threaded fastener to rotate the adjusting nut relative to the threaded fastener.

9. The apparatus of claim 8, wherein:
- the arc shaped portion of the drive access opening extends through an arc in a range of from about 60 degrees to about 120 degrees.

10. The apparatus of claim 1, further comprising:
- a manually powered adjusting nut drive configured to extend downward through the drive access opening to engage the adjusting nut so that a position of the wear plate below the mounting flange is adjustable, the adjusting nut drive including:

a pivot guide configured to be received over the threaded fastener to pivot about a longitudinal axis of the threaded fastener;

a handle extending from the pivot guide; and a drive lug extending downward from the handle to engage the adjusting nut.

11. The apparatus of claim 10, wherein:

the adjusting nut drive includes a ratchet between the drive lug and the handle.

12. The apparatus of claim 10, wherein:

the drive access opening includes an arc shaped portion configured to receive the drive lug and to allow the drive lug to move in an arc about the longitudinal axis of the threaded fastener to rotate the adjusting nut relative to the threaded fastener; and the adjusting nut includes a plurality of notches defined in an outer periphery of the adjusting nut, the notches being configured to receive the drive lug of the adjusting nut drive.

13. The apparatus of claim 12, wherein:

the drive lug includes two substantially parallel opposed driving sides.

14. The apparatus of claim 12, further comprising:

a cylindrical spacer bushing received about the threaded fastener between the mounting flange and the top nut; and wherein the pivot guide of the adjusting nut drive includes a cylindrical bore through the pivot guide, the cylindrical bore being received about the cylindrical spacer bushing when the lug of the adjusting nut drive is engaged with one of the notches of the adjusting nut.

15. The apparatus of claim 1, further comprising:

an automatically powered adjusting nut drive configured to extend downward through the drive access opening to engage the adjusting nut so that a position of the wear plate below the mounting flange is adjustable, the adjusting nut drive including:

a drive motor;

a drive shaft extending downward from the drive motor through the drive access opening;

a drive bushing; and a drive gear attached to the drive shaft below the drive bushing and configured to engage the adjusting nut.

16. The apparatus of claim 15, wherein:

the adjusting nut is configured as a gear having external gear teeth, the external gear teeth having an axial adjusting nut tooth height; and the drive gear has an axial drive gear tooth height greater than the axial adjusting nut tooth height.

17. The apparatus of claim 15, wherein:

the drive access opening includes an at least partially circular portion having a center offset from a longitudinal axis of the threaded fastener; and the drive bushing is configured to be closely received within the at least partially circular portion of the drive access opening.

18. The apparatus of claim 15, wherein:

the at least one adjustable fastener assembly further includes a washer plate received between the mounting flange and the adjusting nut, the washer plate including an eccentric portion extending under the drive access opening, the eccentric portion having a guide opening defined therethrough for closely receiving the drive bushing when the drive gear is engaged with the adjusting nut.

19. A mold apparatus for a slipform paver, the mold apparatus comprising:

a front frame member;

a rear frame member;

at least one of the frame members including a mounting flange having a fastener opening;

a wear plate disposed below the front and rear frame members;

at least one adjustable fastener assembly including:

a threaded fastener attached to the wear plate and extending upward through the fastener opening of the mounting flange;

a top nut attached to the threaded fastener above the mounting flange; and an adjusting nut attached to the threaded fastener below the mounting flange; and a manually powered adjusting nut drive configured to extend downward through the drive access opening to engage the adjusting nut so that a position of the wear plate below the mounting flange is adjustable, the adjusting nut drive including:

a pivot guide configured to be received over the threaded fastener to pivot about a longitudinal axis of the threaded fastener;

a handle extending from the pivot guide; and a drive lug extending downward from the handle to engage the adjusting nut.

20. The apparatus of claim 19, wherein:

the mounting flange includes a drive access opening including an arc shaped portion configured to receive the drive lug and to allow the drive lug to move in an arc about the longitudinal axis of the threaded fastener to rotate the adjusting nut relative to the threaded fastener; and the adjusting nut includes a plurality of notches defined in an outer periphery of the adjusting nut, the notches being configured to receive the drive lug of the adjusting nut drive.

21. The apparatus of claim 20, wherein:

the drive lug includes two substantially parallel opposed driving sides.

22. The apparatus of claim 20, further comprising:

a cylindrical spacer bushing received about the threaded fastener between the mounting flange and the top nut; and wherein the pivot guide of the adjusting nut drive includes a cylindrical bore through the pivot guide, the cylindrical bore being received about the cylindrical spacer bushing when the lug of the adjusting nut drive is engaged with one of the notches of the adjusting nut.

23. A mold apparatus for a slipform paver, the mold apparatus comprising:

a front frame member;

a rear frame member;

at least one of the frame members including a mounting flange having a fastener opening and a drive access opening;

a wear plate disposed below the front and rear frame members;

at least one adjustable fastener assembly including:

a threaded fastener attached to the wear plate and extending upward through the fastener opening of the mounting flange;

a top nut attached to the threaded fastener above the mounting flange; and an adjusting nut attached to the threaded fastener below the mounting flange; and an automatically powered adjusting nut drive configured to extend downward through the drive access opening to engage the adjusting nut so that a position of the wear plate below the mounting flange is adjustable, the adjusting nut drive including:

a drive motor;

a drive shaft extending downward from the drive motor through the drive access opening;

a drive bushing; and a drive gear attached to the drive shaft below the drive bushing and configured to engage the adjusting nut.

24. The apparatus of claim 23, wherein:

the adjusting nut is configured as a gear having external gear teeth, the external gear teeth having an axial adjusting nut tooth height; and the drive gear has an axial drive gear tooth height greater than the axial adjusting nut tooth height.

25. The apparatus of claim 23, wherein:

the drive access opening includes an at least partially circular portion having a center offset from a longitudinal axis of the threaded fastener; and the drive bushing is configured to be closely received within the at least partially circular portion of the drive access opening.

26. The apparatus of claim 23, wherein:

the at least one adjustable fastener assembly further includes a washer plate received between the mounting flange and the adjusting nut, the washer plate including an eccentric portion extending under the drive access opening, the eccentric portion having a guide opening defined therethrough for closely receiving the drive bushing when the drive gear is engaged with the adjusting nut.

* * * * *